US010206460B2

(12) United States Patent
Skipper et al.

(10) Patent No.: US 10,206,460 B2
(45) Date of Patent: Feb. 19, 2019

(54) BELT FASTENER SYSTEM INCLUDING A BUCKLE MECHANISM

(71) Applicants: Debra Ruth Skipper, St.Pete Beach, FL (US); Brenda Colleen Guy, St.Pete Beach, FL (US)

(72) Inventors: Debra Ruth Skipper, St.Pete Beach, FL (US); Brenda Colleen Guy, St.Pete Beach, FL (US)

( * ) Notice: Subject to any disclaimer, the term of this patent is extended or adjusted under 35 U.S.C. 154(b) by 909 days.

(21) Appl. No.: 14/621,807

(22) Filed: Feb. 13, 2015

(65) Prior Publication Data

US 2015/0257493 A1 Sep. 17, 2015

Related U.S. Application Data

(60) Provisional application No. 61/951,876, filed on Mar. 12, 2014.

(51) Int. Cl.

| | |
|---|---|
| ***A44B 11/22*** | (2006.01) |
| ***A44B 11/04*** | (2006.01) |
| ***A41F 9/00*** | (2006.01) |
| ***A44B 11/00*** | (2006.01) |

(52) U.S. Cl.

CPC ..... *A44B 11/22* (2013.01); *A41F 9/002* (2013.01); *A44B 11/005* (2013.01); *A44B 11/04* (2013.01); *A44D 2205/00* (2013.01); *Y10T 24/406* (2015.01)

(58) Field of Classification Search

CPC ..... A44B 11/22; A44B 11/005; A41F 9/02; A41F 9/00; A41F 9/002

See application file for complete search history.

(56) References Cited

U.S. PATENT DOCUMENTS

| | | | | | |
|---|---|---|---|---|---|
| 135,744 | A * | 2/1873 | Adams | A44B 11/006 | 24/164 |
| 154,673 | A * | 9/1874 | Smith et al. | A44B 11/22 | 24/164 |
| 1,481,911 | A * | 1/1924 | Kalk | A44B 11/00 | 24/163 R |
| 2,079,981 | A * | 5/1937 | Bednall | A44B 11/24 | 24/170 |
| 3,272,410 | A * | 9/1966 | Reisman | A44B 11/005 | 224/163 |
| 3,295,178 | A * | 1/1967 | Smith | A44B 11/006 | 2/322 |

(Continued)

*Primary Examiner* — Richale Quinn

(74) *Attorney, Agent, or Firm* — H. John Rizvi; John Rizvi, P.A.

(57) ABSTRACT

A waist belt fastener system includes a belt and a buckle mechanism attached to the belt. The buckle includes a rectangular frame having upper and lower sides that are curved outwardly, creating a convex shape that curves away from the belt wearer. At the rear side of the buckle frame where the buckle attaches to the belt, a fixed tongue member projects away from the buckle frame. This tongue member is fastened to the belt such as by a rivet, firmly anchoring and securing the buckle to the belt and inhibiting movement of the buckle relative to the belt. At the front side of the buckle frame, a fixed prong projects inwardly towards the buckle opening. The prong rests against the belt once it is threaded through the buckle opening. A hook and loop closure system is used to attach the ends of the belt together once the belt is inserted through the buckle opening.

17 Claims, 6 Drawing Sheets

(56) References Cited

U.S. PATENT DOCUMENTS

| | | | | | |
|---|---|---|---|---|---|
| 3,440,667 | A | * | 4/1969 | Dye | A41F 9/002 2/325 |
| 3,885,250 | A | | 5/1975 | Schiller | |
| 4,062,066 | A | * | 12/1977 | Weiss | A41F 9/002 2/322 |
| 4,100,655 | A | | 7/1978 | Langley | |
| 4,203,167 | A | * | 5/1980 | Collins | A44B 11/005 2/322 |
| 4,313,230 | A | * | 2/1982 | Chovaniec | A41F 9/002 2/322 |
| 4,999,853 | A | | 3/1991 | Tanner | |
| 5,367,714 | A | * | 11/1994 | Hines | A41F 9/002 2/311 |
| 6,678,898 | B2 | | 1/2004 | Jones et al. | |
| 6,687,916 | B2 | * | 2/2004 | Thompson | A44C 5/0007 2/16 |
| 6,779,201 | B1 | * | 8/2004 | Pfrommer | A44B 11/006 2/321 |
| 6,830,166 | B1 | * | 12/2004 | Laats | A44C 5/0053 224/164 |
| 6,954,946 | B2 | | 10/2005 | Goldfarb et al. | |
| D585,181 | S | | 1/2009 | Mouquet | |
| 7,712,155 | B1 | | 5/2010 | Pantoja | |
| 7,856,672 | B1 | * | 12/2010 | Koehler | A41F 9/002 2/312 |
| 2006/0101623 | A1 | | 5/2006 | Herley | |

* cited by examiner

BELT FASTENER SYSTEM INCLUDING A BUCKLE MECHANISM

FIELD OF THE INVENTION

The present invention relates to a belt fastener system, and more particularly, to a buckle mechanism that stabilizes the movement of the buckle within the waist belt.

BACKGROUND OF THE INVENTION

A belt buckle is a clasp or fastening device used to join the loose ends of a belt or strap. The buckle typically has a flat rectangular frame. The buckle is attached to one end of the belt by looping the belt end over one side of the buckle frame, folding it back on itself, and securing this belt end to the inside of the belt, capturing one side of the buckle frame within a pocket or sleeve created by this belt loop. In this attached position, the belt buckle can freely move and swings back and forth. A hinged pin or prong is attached to the side of the buckle frame that is captured by the loop at the end of the belt. The hinged prong can freely pivot from this bar. The prong aids in cinching the belt around the waist of the wearer by insertion through an appropriate eyelet formed in the belt, after the free end of the belt has been threaded through the opening in the buckle frame.

The free movement of the belt buckle requires that a user employ both hands to fasten the belt. One hand must hold the buckle firmly in place while the other hand threads the free end of the belt through the buckle opening. Even after this threading exercise, the user must still exhibit a precise dexterity in handling the belt and buckle combination by first drawing the belt back against the buckle in a tightening motion, and then carefully inserting the buckle prong into the appropriate eyelet in the belt. As before with the threading operation, both hands are necessary in this cinching operation: one hand draws the free end of the belt tight while the other hand maneuvers the buckle prong into the appropriate eyelet in the belt. The manipulation of the belt and buckle, while a common task for most people, can present significant challenges for other individuals. The two-handed operation makes conventional belts very difficult to use for individuals who do not have both hands available or who have impaired dexterity in their hands or fingers.

A user with only a single available hand would find it very difficult to manage the threading operation, since the conventional belt buckle freely pivots within its attached position at the end of the belt. Even if such a user does succeed in threading the free end of the belt through the buckle opening, and is able to cinch the belt tight, there is the further challenge of how to insert the pivoting buckle prong through the appropriate belt eyelet.

Accordingly, there remains a need in the art for a belt fastener system that can support a one-handed operation and that reduces the number of moving parts in the buckle design, creating a more stable fastening mechanism.

SUMMARY OF THE INVENTION

The present invention overcomes the deficiencies of the known art and the problems that remain unsolved by providing a belt fastener system including a belt and buckle mechanism, a combination that offers improved stability regarding movement of the buckle, enabling the belt to be fastened using a single-handed operation.

In accordance with a first implementation of the present invention, a belt fastener comprises:

- a belt having a free end and a buckle end, the belt further having an inner side and an outer side;
- a buckle attached to the belt at the buckle end, the buckle comprising:
  - a frame defining an opening, the frame including:
    - a frame body having a front side, a rear side generally opposite the front side, an upper side, and a lower side generally opposite the upper side,
  - a fixed tongue member extending from the rear side of the frame body in a direction generally away from the buckle frame opening;
- a fastener, such as a rivet, the fastener joining the tongue member of the buckle to the belt at the buckle end of the belt; and
- a fastener, such as a hook member or loop member, the fastener disposed at the free end of the belt at the inner side thereof, and a mating fastener, such as a mating loop member or hook member, the mating fastener disposed at the buckle end of the belt at the outer side thereof.

In a second aspect, the buckle has a unibody construction.

In another aspect, the buckle further comprises a fixed prong extending from the front side of the frame body in a direction generally towards the buckle frame opening.

In another aspect, the prong extends generally from a midpoint of the front side of the frame body.

In another aspect, the buckle frame body has a generally convex shape.

In another aspect, the upper side and the lower side of the buckle frame body curve outwardly away from the waist side of the buckle to define the convex shape.

In another aspect, the frame body has a generally rectangular shape.

In another aspect, the tongue member has a generally rectangular, solid body shape.

In another aspect, the tongue member extends generally parallel to a plane connecting the front side and the rear side of the frame body.

In another aspect, the tongue member extends from the rear side of the frame body in a direction generally opposite the buckle frame opening.

In another aspect, the belt at the buckle end thereof threads through the buckle frame opening from an exterior side of the belt opposite the waist side, folds back over the rear side of the frame body, and covers the tongue member, such that the tongue member in its riveted condition is sandwiched between sections of the belt.

In yet another aspect, the belt buckle is substantially immovable relative to the belt.

In accordance with a second implementation of the present invention, a belt fastener comprises:

- a belt having a free end and a buckle end, the belt further having an inner side and an outer side;
- a buckle attached to the belt at the buckle end, the buckle having a waist side and an exterior side opposite the waist side, the buckle comprising:
  - a frame defining an opening, the frame including:
    - a generally rectangular frame body having a front side and a rear side disposed in generally opposing relationship, the frame body further having an upper side and a lower side disposed in generally opposing relationship,
    - the upper side of the frame body and the lower side of the frame body each curving away from the waist side of the buckle and towards the exterior side thereof to define a generally convex shape of the frame body;

a fixed shank projection extending from the rear side of the frame body in a direction generally away from the buckle frame opening;

a fastener, such as a rivet, joining the shank projection of the buckle to the belt at the buckle end of the belt; and a fastener, such as a hook member or a loop member, the fastener disposed at the free end of the belt at the inner side thereof, and a mating fastener, such as a mating loop member or hook member, the mating fastener disposed at the buckle end of the belt at the outer side thereof.

In second aspect, the buckle further comprises a fixed finger projection extending from the front side of the frame body in a direction generally towards the buckle frame opening.

In another aspect, the belt buckle is substantially immovable relative to the belt.

In another aspect, the shank projection extends generally parallel to a plane connecting the front side and the rear side of the frame body.

In yet another aspect, the belt at the buckle end thereof threads through the buckle frame opening from the exterior side of the belt, wraps around the rear side of the frame body, and covers the shank projection, such that the shank projection in its riveted condition is sandwiched between sections of the belt.

In accordance with a third implementation of the present invention, a belt buckle has a waist side and an exterior side opposite the waist side, the belt buckle further comprising:

a frame having a unibody construction, the frame including:

a frame body, the frame body including:

a front side and a rear side disposed in generally opposing relationship, a central opening defined by the frame;

a tongue projection extending from the rear side of the frame body in a direction generally away from the central opening; and at least one fixed finger prong extending from the front side of the frame body in a direction generally towards the central opening.

In a second aspect, the tongue projection extends generally parallel to a plane connecting the front side and the rear side of the frame body.

In another aspect, the at least one finger prong consists of a single finger prong extending from a midpoint of the front side of the frame body.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall be used to describe the invention in accordance with their common meaning Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 4:
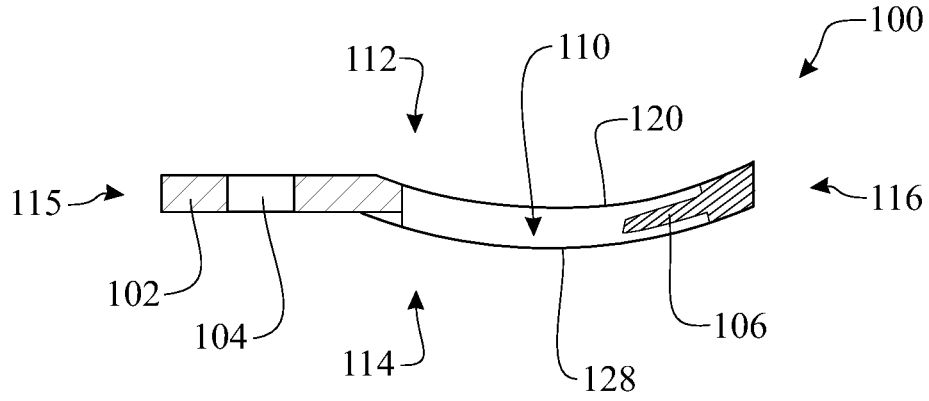
FIG. 4 presents a cross-sectional top plan view of the belt originally introduced in FIG. 1, taken along the section line 4-4 of FIG. 3.
Figure 5:
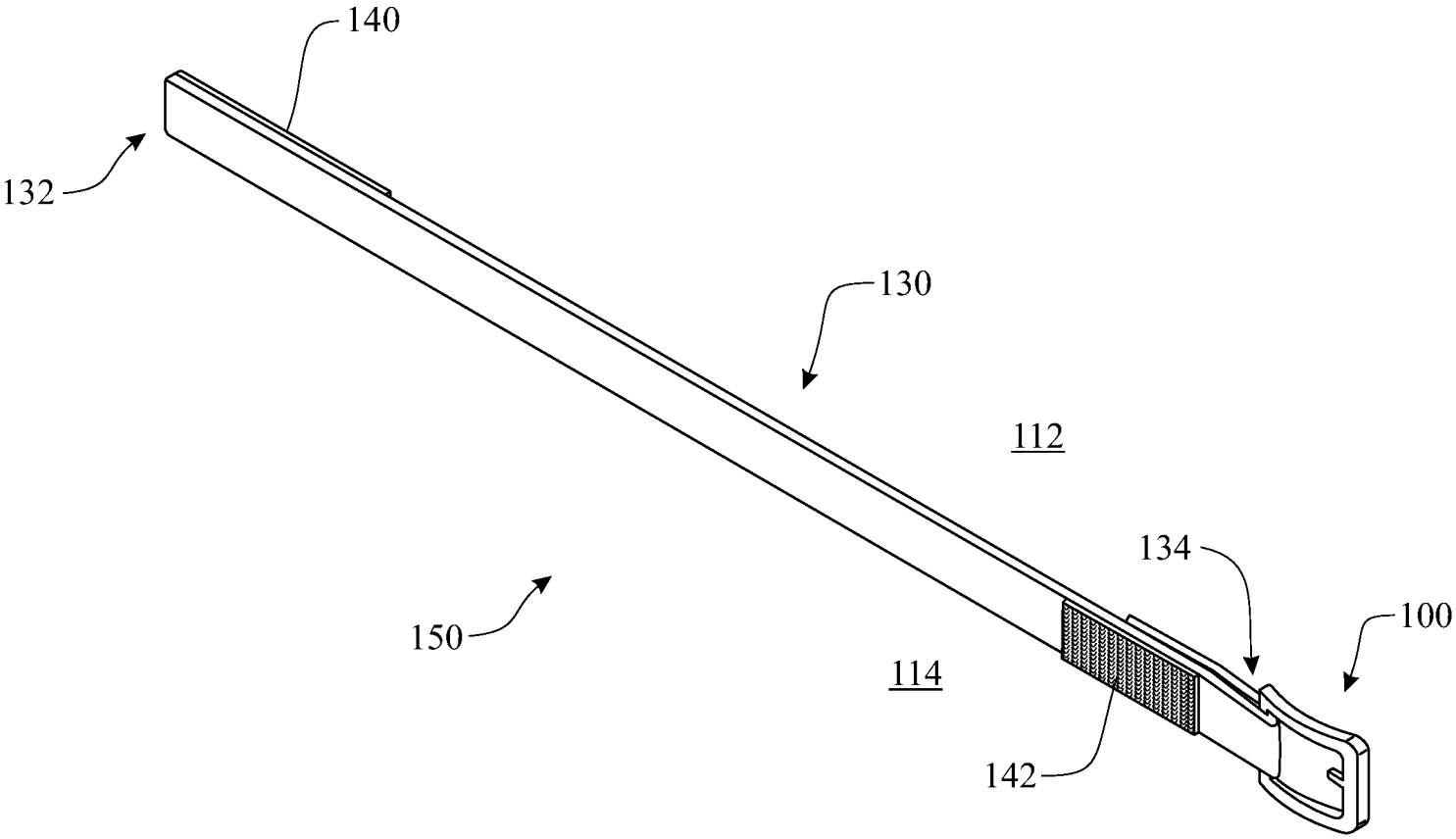
FIG. 5 presents an isometric front view of an exemplary belt fastener system incorporating the belt buckle originally introduced in FIG. 1.
Figure 6:
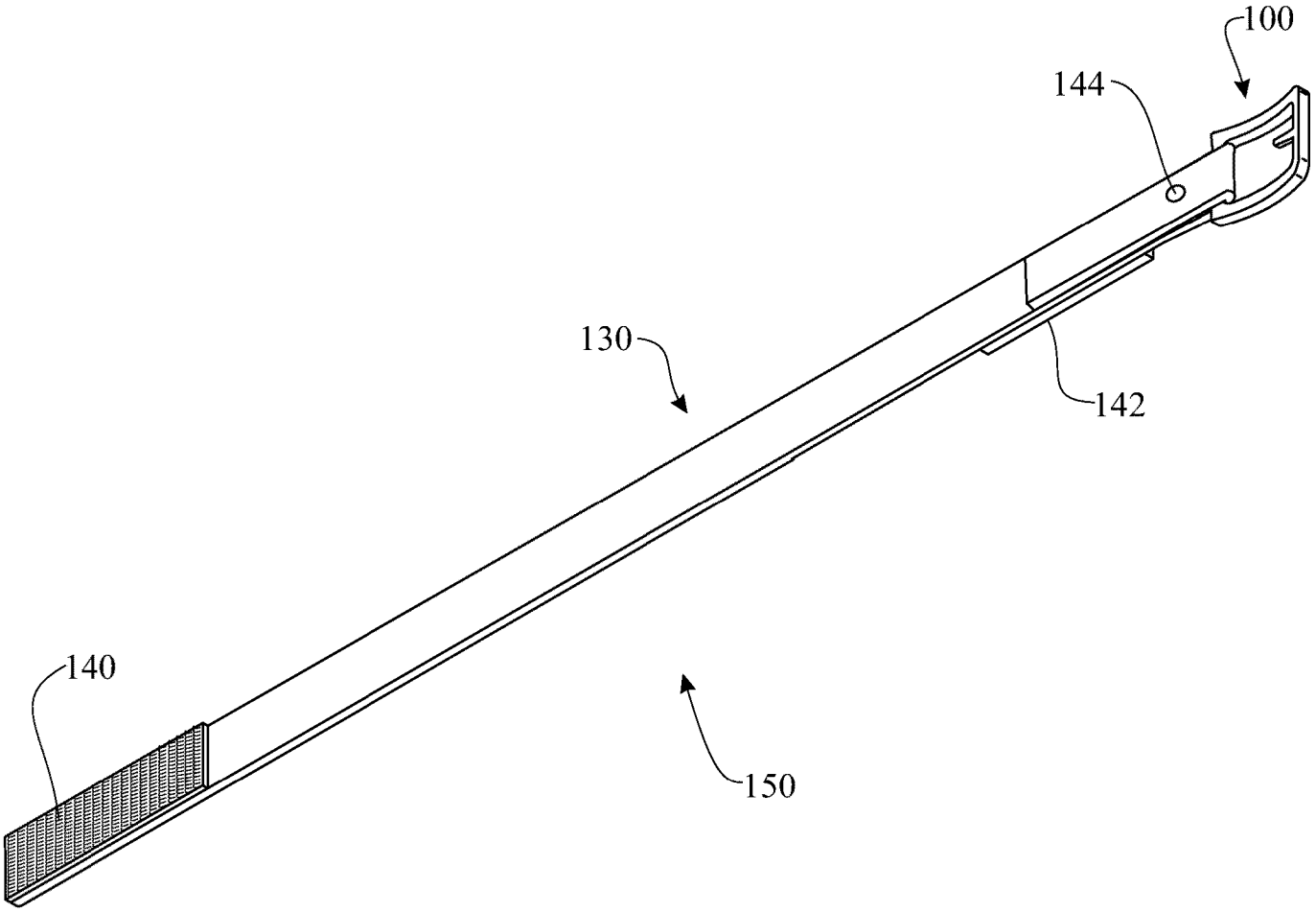
FIG. 6 presents an isometric rear view of the belt fastener system originally introduced in FIG. 5.
Figure 7:
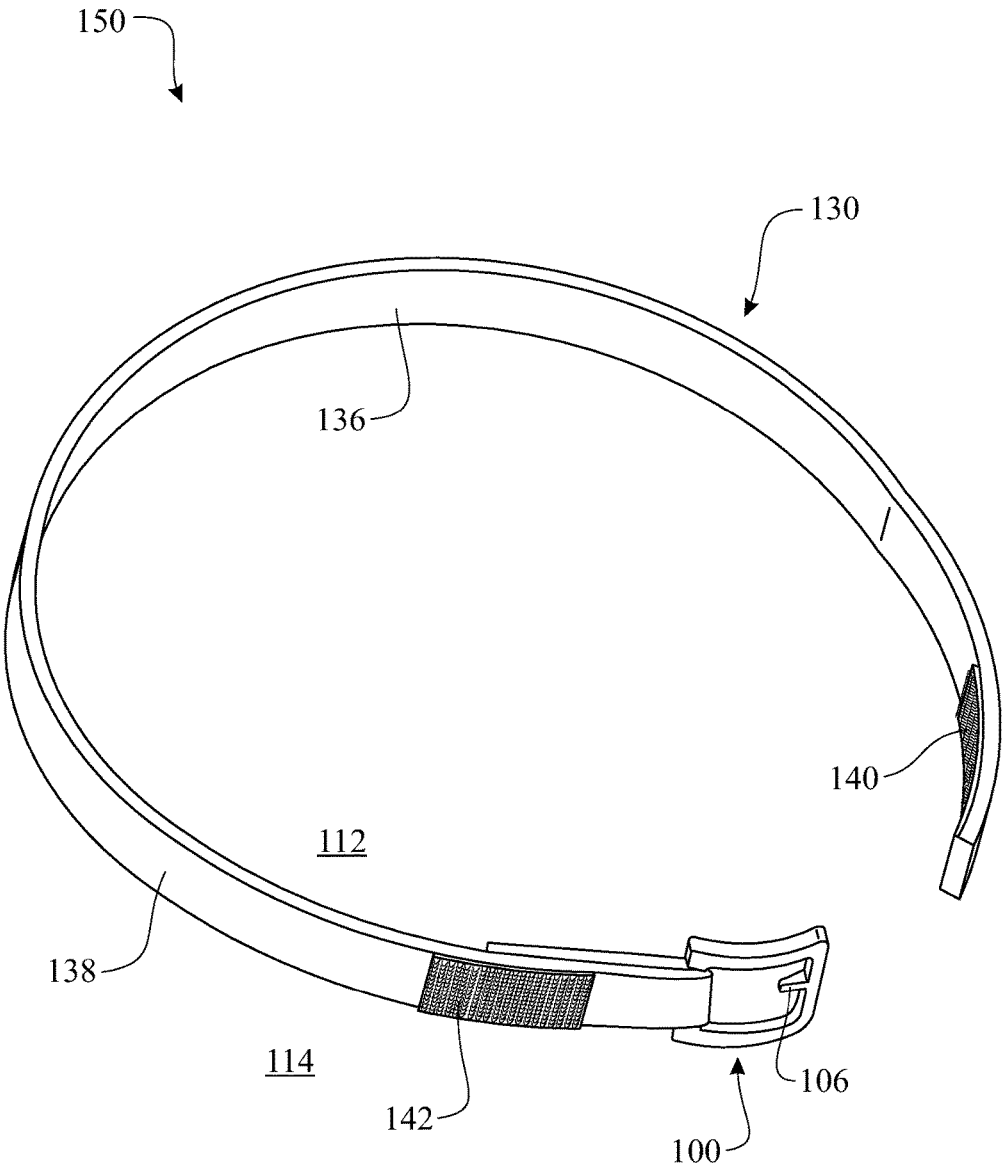
FIG. 7 presents an isometric front view of the belt fastener system originally introduced in FIG. 5, demonstrating the belt in a curved orientation similar to its mode of use when worn by a user to cinch a garment.

A buckle mechanism 100 is presented in various configurations in the illustrations of FIGS. 1 through 4. The buckle 100 includes a frame 118 having a body 120 that defines an interior space or opening 110 through which an attached belt is maneuvered during operation. As shown in FIG. 4, the buckle 100 has a waist side 112 (proximate the wearer) and an exterior side 114 (distal the wearer). The buckle 100 includes an attachment end 115 where the buckle 100 is to attach to a belt, and a free end 116 opposite the attachment end 115.

Figure 1:
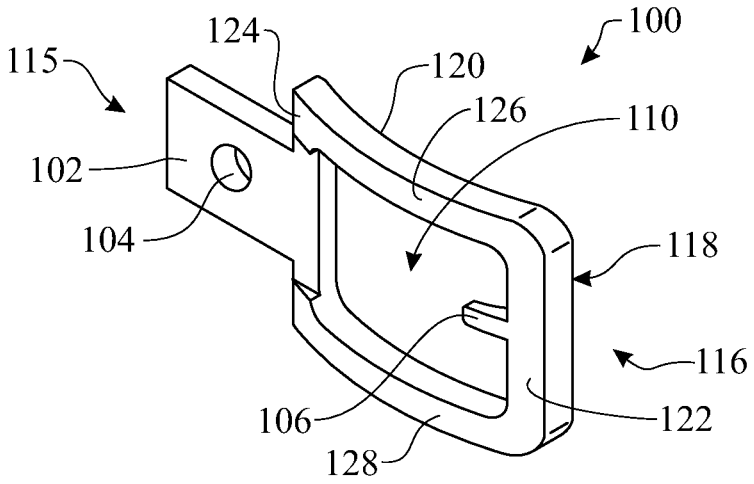
FIG. 1 presents an isometric view of a belt buckle according to an exemplary embodiment of the invention.
Figure 2:
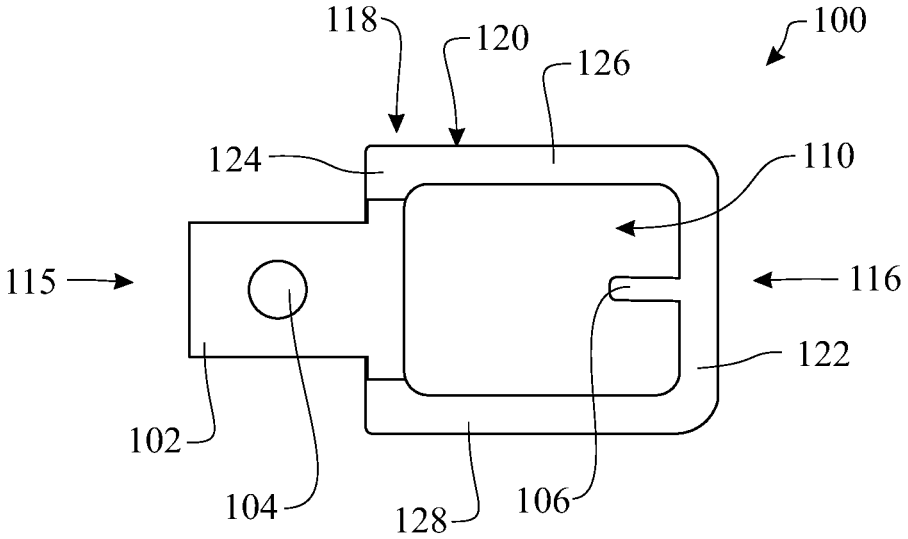
FIG. 2 presents a front elevation view of the belt buckle originally introduced in FIG. 1.
Figure 3:
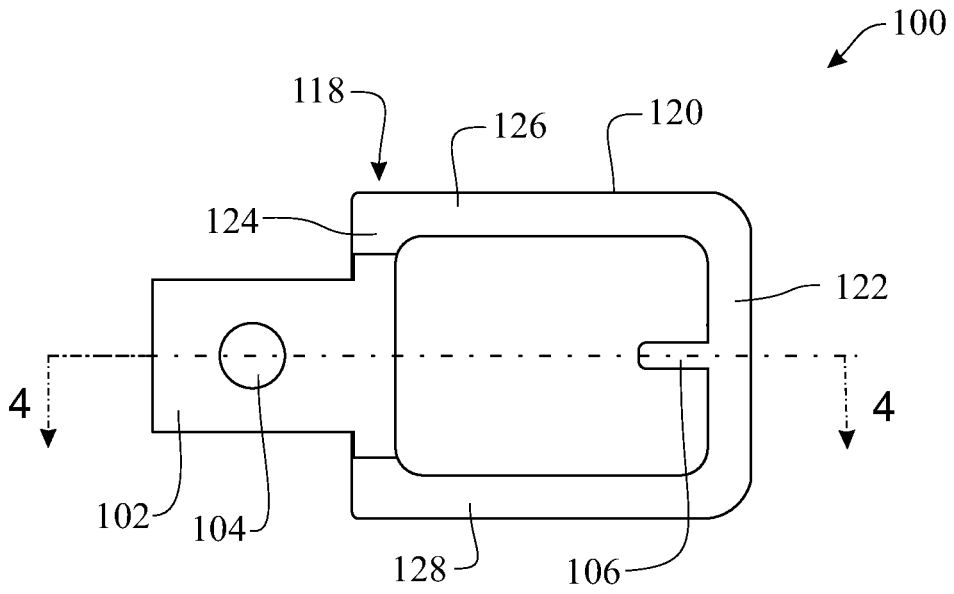
FIG. 3 presents a front elevation view of the belt buckle originally introduced in FIG. 1, demonstrating section line 4-4.

As best shown in FIGS. 1 and 2, the body 120 of buckle frame 118 includes a front (forward) or outer side 122 disposed at the free end 116 of buckle 100; a rear or inner side 124 disposed at the attachment end 115 of buckle 100; an upper side 126; and a lower side 128. In one exemplary form, the buckle frame 118 has a generally rectangular shape. Accordingly, the front side 122 and the rear side 124 are disposed in generally opposing and parallel relationship to one another, while the upper side 126 and the lower side 128 are disposed in generally opposing and parallel relationship to one another. Other geometries are possible for buckle frame 118, including an oval, circular, or rounded shape. The combination of front side 122, rear side 124, upper side 126, and lower side 128 defines the contour of frame 118 and constitutes a set of edges, ends, posts, bars, and frame pieces of buckle frame 118.

In an exemplary form, the upper side 126 and the lower side 128 of the frame body 120 are curved outwardly towards the exterior side 114 and away from the waist side 112 of buckle 100 (i.e., away from the wearer), as best shown in FIGS. 1 and 4. This curvature produces a convex shape to the buckle frame 118 that promotes ease of fit and comfort. The curvature can be adjusted during the manufacturing process of buckle 100 to produce any desired degree of curvature or convexity.

The buckle 100 further includes a tongue member 102 that projects from the rear side 124 of frame body 120 at the attachment end 115 of buckle 100. The tongue 102 is fixedly mounted or attached to frame body 120 in a rigid, stationary connection. There is no relative movement between tongue 102 and frame body 120. In an exemplary form, the tongue 102 is provided as a unitary piece with frame body 120. The tongue 102 preferably extends in a direction generally parallel to a plane defined by the front side 122 and the rear side 124 of frame body 120, as best seen in FIG. 4. In particular, the tongue 102 extends in a direction generally opposite the buckle opening 110. The tongue 102 can be variously characterized as an extension element, a projection, an ear component, a mounting element, a shank, or a tang. In an exemplary form, the tongue 102 extends from a midsection of the rear side 124 of frame body 120.

The tongue 102 serves as the connection point for attaching and securing the buckle 100 to belt 130 at the attachment end 115 of buckle 100, as presented in FIGS. 5 through 9. For this purpose, the tongue 102 includes a through hole 104. In turn, the belt 130 includes a free end 132, a buckle end 134 opposite the free end 132, an inside or inner portion 136 facing towards the wearer, and an outside or outer portion 138 facing away from the wearer. During assembly, the buckle end 134 of belt 130 is threaded or looped through the buckle opening 110 from the exterior side 114 of buckle 100 and folded or wrapped around the rear side 124 of frame body 120 at the attachment end 115 of buckle 100. In this threaded wrap-around position, the buckle end 134 of belt 130 is folded over on itself in a manner sufficient to cover the tongue 102 on both sides. The tongue 102 is now sandwiched between opposing sections of belt 130 at its buckle end 134. A fastening rivet 144 is now used to secure the belt 130 to tongue 102, by passing through the through hole 104 of the tongue 102; the fastening rivet 144 thus functions to attach the buckle 100 to belt 130. The use of rivet 144 to fasten the tongue 102 to belt 130 creates a very tight and rigid coupling between the buckle 100 and belt 130 that renders the buckle 100 substantially immovable relative to belt 130.

The riveted fastening of the buckle 100 to belt 130 via tongue 102, in combination with the fixed rigid connection of tongue 102 to the buckle frame 118, produces a very stable and fixed mechanical coupling between the belt 130 and buckle 100. There is substantially no movement between the buckle 100 and belt 130. The tongue 102, along with its riveted fastening to belt 130, functions as a stabilizer mechanism that prevents the buckle 100 from flopping around as one is attempting to buckle and secure the belt 130, unlike conventional buckle mechanisms where the buckle freely swings at the end of the belt. The rigid stabilization of the buckle 100 is especially adapted for use by handicapped individuals, young children, or others with dexterity issues because there are no moving parts in the assembled buckle 100 and belt 130 combination. Even better, the buckle 100 and belt 130 can be effectively manipulated in a one-handed operation due to the rigid positioning of buckle 100 relative to belt 130, since there is no need for a free hand to be available to hold the buckle 100 in place while the free end 132 of belt 130 is looped through the buckle opening 110 during operation, i.e., as the wearer is putting on belt 130.

The tongue 102 preferably has a solid body metal construction. In an exemplary form, the tongue 102 has a generally rectangular shape, although other suitable shapes are possible. The geometry and design of tongue 102 are selected with a view towards ensuring the maximum amount of mechanical rigidity, and hence stabilization, between the buckle 100 and belt 130 once the tongue 102 is riveted to belt 130 in the assembled configuration. The rivet 144 serves as the means for fastening buckle 100 to belt 130 via tongue 102. The rivet 144 is especially adapted for use in this application since a riveted connection forms a very firm and stationary coupling between the parts, i.e., belt 130 and tongue 102 (with buckle 100) are rendered relatively immovable with respect to one another. However, it should be apparent that other suitable means can be used to fasten buckle 100 to belt 130 via tongue 102, keeping in view the need to create a rigid mechanical joint between the buckle 100 and belt 130. The riveted connection between the tongue extension 102 and belt 130 anchors the buckle 100 to the belt 130, making the buckle 100 an immovable part relative to belt 130.

Figure 8:
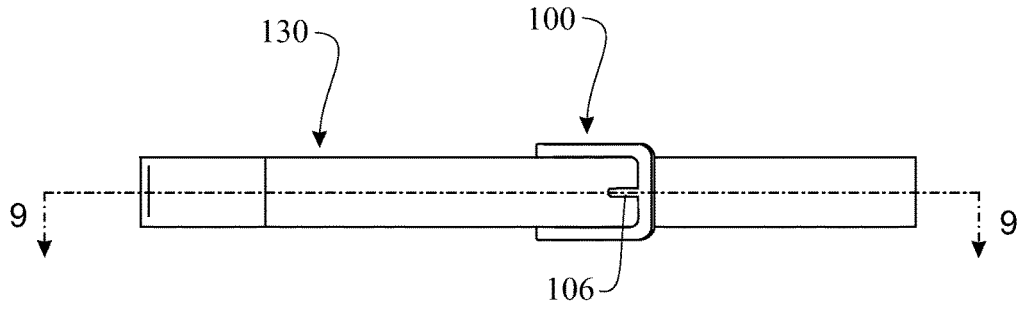
FIG. 8 presents a front elevation view of the belt fastener system originally introduced in FIG. 5, demonstrating the manner in which the belt ends are fastened together during user operation to secure and cinch a garment.
Figure 9:
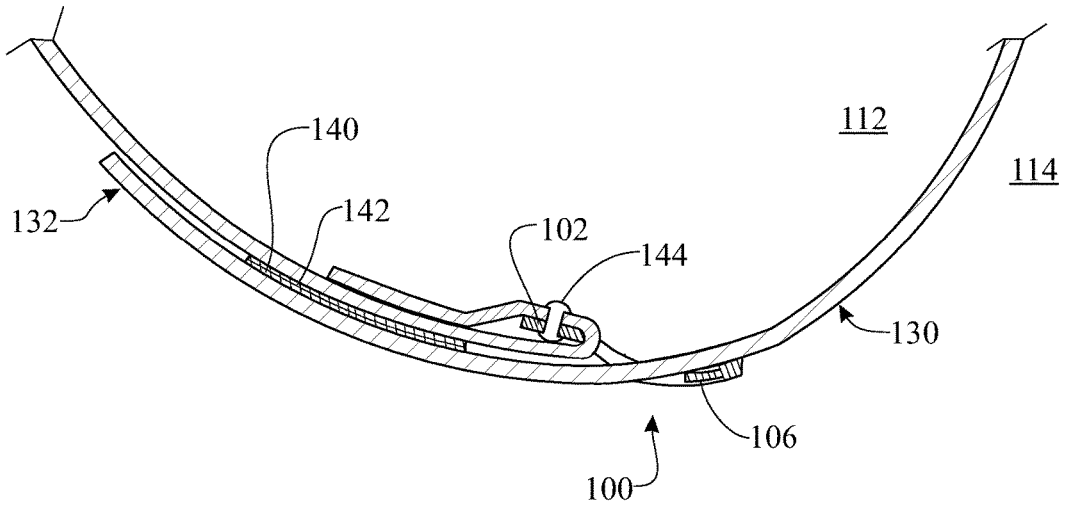
FIG. 9 presents a slightly enlarged cross-sectional top plan view of the belt fastener system originally introduced in FIG. 5, taken along the section line 9-9 of FIG. 8.

Turning back to FIG. 1, the buckle 100 preferably includes a prong or elongate finger projection 106 that extends from an inner surface of the front side 122 of frame body 120 towards the buckle opening 110. As shown in FIGS. 8 and 9, the prong 106 rests against the belt 130 once the belt 130 is threaded through the buckle opening 110 during installation (wearing) of the belt 130, helping to resist any outward bulging of the belt 130. The prong 106 also features an aesthetic appearance in resemblance of the hinged movable prong present in conventional buckle mechanisms. The prong 106 has a solid body construction that is rigidly fixed to the frame body 120 at its front side 122. The prong 106 preferably has a unibody construction with the frame body 120. In alternate forms, the prong 106 can extend in various directions and angles from the front side 122 of frame body 120. In an exemplary form, the prong 106 extends from a midpoint or midsection of the front side 122 of frame body 120.

The illustrations of FIGS. 5, 6, 7 and 9 further present an additional feature comprised in the belt 130 of the present embodiment. As shown, the belt 130 includes a hook-and-loop fastener combination including a loop element 140 attached to the inside 136 of belt 130 at its free end 132, and a hook element 142 attached to the outside 138 of belt 130 at its buckle end 134. The loop element 140 and hook element 142 are preferably made of suitable hook-and-loop materials such as, but not limited to, Velcro®, although other suitable fastening elements such as snap fasteners, hooks, magnets, or the like can be used to secure the free end 132 of belt 130 to the buckle end 134 of belt 130. In a conventional manner, the loop element 140 and hook element 142 can engage and mate together in a reversible fastening connection.

During installation, as the user or wearer attempts to put on the belt system 150, the user initially inserts the free end 132 of belt 130 through the buckle opening 110 from the waist side 112 of buckle 100. The loop element 140 is now facing towards the outside 138 of belt 130 and is thus in a position to be engaged to hook element 142. Depending upon how securely the user wants to cinch the belt 130 around the waist, the user can maneuver the free end 132 of belt 130 and continue to coil or wrap the free end 132 around the waist until a desired tightness is reached. At this point, the user mates or engages the loop element 140 to the hook element 142 to firmly secure the belt 130 in its worn position, as best shown in FIG. 9. The belt system 150 requires no manipulation of mechanical parts into an interlocking arrangement, such as the insertion of a hinged movable prong into a belt eyelet of conventional belts. Instead, the belt system 150 allows the user to secure the ends of the belt together by simply mating the loop element 140 and hook element 142 together in a simple press engagement. Likewise, the belt system 150 can be easily opened and removed by simply releasing the loop element 140 from the hook element 142 in a typical tearing or pulling operation, then maneuvering the free end 132 of belt 130 back through the buckle opening 110. The fastening of the loop element 140 to the hook element 142 only requires a single hand to manipulate the belt 130 into position, compared to conventional belts that require one hand to maneuver the free end of the belt and another to hold the buckle. In the invention, the buckle 100 is held firmly in place by its rigid mechanical connection to belt 130 via the riveted fastening of tongue 102 to belt 130, avoiding any need by the user to hold the buckle 100 either during installation or removal of belt 130.

The buckle extension or tongue 102 stabilizes the position of buckle 100 relative to belt 130, allowing one-handed operation of buckle 100 and the fastening of belt 130. The buckle extension 102 and hook-and-loop closure (i.e., loop element 140 and hook element 142) make the belt simple and easy to wear and operate, particularly with one hand. The belt has the appearance of a normal belt article; however, the belt buckle extension 102 and the use of loop element 140 and hook element 142 material make the belt easy to operate, i.e., put on, open, and remove.

Various modifications are possible with the buckle 100 and belt 130 combination. The buckle 100 can be provided in any of various suitable shapes, such as a rounded or square shape. The fastener system for securing the ends of belt 130 can be implemented with any suitable combination of hook and loop materials, in addition to Velcro®. The belt 130 can be made from any type of material, such as leather. The buckle 100 is preferably made with a solid, unibody construction, although it is possible to design buckle 100 with frame 118 and then attach the tongue 102 and prong 106 to frame 118 in a suitable manner, such as a welding operation. The buckle 100 is constructed so that tongue 102 is rigidly fixed to frame 118.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

What is claimed is:

1. A belt fastener system, comprising:

a belt having a free end and a buckle end, the belt further having an inner side and an outer side;

a buckle attached to the belt at the buckle end, said buckle comprising:

a frame defining an opening, the frame including:

a frame body having a front side, a rear side generally opposite the front side, an upper side, and a lower side generally opposite the upper side, a fixed tongue member extending from the rear side of the frame body in a direction generally away from the opening of the frame;

a fastener joining the tongue member of the buckle to the belt at the buckle end of the belt; and a fastener disposed at the free end of the belt at the inner side thereof and a mating fastener disposed at the buckle end of the belt at the outer side thereof.

2. The belt fastener of claim 1, wherein the buckle has a unibody construction.

3. The belt fastener of claim 1, wherein the buckle further comprises a fixed prong extending from the front side of the frame body in a direction generally towards the opening of the frame.

4. The belt fastener of claim 3, wherein the prong extends generally from a midpoint of the front side of the frame body.

5. The belt fastener of claim 1, wherein the frame body has a generally convex shape.

6. The belt fastener of claim 5, wherein the upper side and the lower side of the frame body curve outwardly away from the waist side of the buckle to define the convex shape.

7. The belt fastener of claim 1, wherein the frame body has a generally rectangular shape.

8. The belt fastener of claim 1, wherein the tongue member has a generally rectangular, solid body shape.

9. The belt fastener of claim 1, wherein the tongue member extends generally parallel to a plane connecting the front side and the rear side of the frame body.

10. The belt fastener of claim 1, wherein the tongue member extends from the rear side of the frame body in a direction generally opposite the opening of the frame.

11. The belt fastener of claim 1, wherein the belt at the buckle end thereof is arranged threaded through the buckle frame opening from an exterior side of the belt opposite the waist side, folded back over the rear side of the frame body, and covering the tongue member, such that the tongue member in its fastened condition is sandwiched between sections of the belt.

12. The belt fastener of claim 1, wherein the buckle is substantially immovable relative to the belt.

13. A belt fastener comprising:

a belt having a free end and a buckle end, the belt further having an inner side and an outer side;

a buckle attached to the belt at the buckle end, the buckle having a waist side and an exterior side opposite the waist side, said buckle comprising:

a frame defining an opening, the frame including:

a generally rectangular frame body having a front side and a rear side disposed in generally opposing relationship, the frame body further having an upper side and a lower side disposed in generally opposing relationship, the upper side of the frame body and the lower side of the frame body each curving away from the waist side of the buckle and towards the exterior side of the buckle to define a generally convex shape of the frame body;

a fixed shank projection extending from the rear side of the frame body in a direction generally away from the buckle frame opening;

a fastener joining the shank projection of the buckle to the belt at the buckle end of the belt; and a fastener disposed at the free end of the belt at the inner side thereof and a mating fastener disposed at the buckle end of the belt at the outer side thereof.

14. The belt fastener of claim 13, wherein the buckle further comprises a fixed finger projection extending from the front side of the frame body in a direction generally towards the opening of the frame.

15. The belt fastener of claim 13, wherein the buckle is substantially immovable relative to the belt.

16. The belt fastener of claim 13, wherein the shank projection extends generally parallel to a plane connecting the front side and the rear side of the buckle frame body.

17. The belt fastener of claim 13, wherein the belt at the buckle end thereof is arranged threaded through the buckle frame opening from the exterior side of the belt, wrapped around the rear side of the frame body, and covering the shank projection, such that the shank projection in its fastened condition is sandwiched between sections of the belt.

* * * * *